US009748724B2

(12) United States Patent
Sato

(10) Patent No.: US 9,748,724 B2
(45) Date of Patent: Aug. 29, 2017

(54) METHOD OF CONNECTING ELECTRIC CABLE TO CONNECTOR TERMINAL AND COMPRESSION-MOLDING DIE

(71) Applicant: YAZAKI CORPORATION, Tokyo (JP)

(72) Inventor: Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 135 days.

(21) Appl. No.: 14/185,266

(22) Filed: Feb. 20, 2014

(65) Prior Publication Data

US 2014/0165393 A1 Jun. 19, 2014

Related U.S. Application Data

(63) Continuation of application No. PCT/JP2012/071372, filed on Aug. 17, 2012.

(30) Foreign Application Priority Data

Aug. 24, 2011 (JP) ..... 2011-182992

(51) Int. Cl.
*H01R 43/24* (2006.01)
*H01R 4/70* (2006.01)
(Continued)

(52) U.S. Cl.
CPC ..... *H01R 43/24* (2013.01); *H01R 4/70* (2013.01); *H01R 43/005* (2013.01); *H01R 4/185* (2013.01);
(Continued)

(58) Field of Classification Search
CPC .... H01R 43/005; H01R 43/048; H01R 43/24; H01R 4/185; H01R 4/70
See application file for complete search history.

(56) References Cited

U.S. PATENT DOCUMENTS 4,667,398 A * 5/1987 Leiby ..... H01R 43/015 29/566.3
4,979,291 A * 12/1990 Phillips ..... H01R 43/055 29/753
(Continued)

FOREIGN PATENT DOCUMENTS

CN 101237109 A 8/2008
CN 101341632 A 1/2009
(Continued)

OTHER PUBLICATIONS

Office Action dated Jun. 2, 2015, issued by the Japanese Intellectual Property Office in counterpart Japanese Application No. 2011-182992.
(Continued)

*Primary Examiner* — Minh Trinh
(74) *Attorney, Agent, or Firm* — Sughrue Mion, PLLC

(57) ABSTRACT

A method of connecting an electric cable to a connector terminal includes arranging a connector terminal in a lower die so that an end portion of the electric cable in which a core wire is exposed from an outer cover is arranged in a barrel portion of the connector terminal, pressing a crimper to the barrel portion to crimp the barrel portion, overlapping the lower die with an upper die to form an injection space around the barrel portion and the end portion of the electric cable, and injecting a resin in an injection space, thereby forming a resin mold that covers and waterproofs the barrel portion and the end portion of the electric cable.

5 Claims, 4 Drawing Sheets

(51) Int. Cl.
*H01R 43/00* (2006.01)
*H01R 4/18* (2006.01)
*H01R 43/048* (2006.01)

(52) U.S. Cl.
CPC ..... *H01R 43/048* (2013.01); *Y10T 29/49176* (2015.01); *Y10T 29/53235* (2015.01)

(56) References Cited

U.S. PATENT DOCUMENTS

| | | | | |
|---|---|---|---|---|
| 5,671,528 | A * | 9/1997 | Endo | H01R 43/058 29/753 |
| 6,334,798 | B1 * | 1/2002 | Ushijima | H01R 4/187 439/203 |
| 6,656,002 | B2 * | 12/2003 | Zhao | H01R 13/187 439/787 |
| 7,048,551 | B2 * | 5/2006 | Takayama | H01R 4/185 439/67 |
| 7,241,185 | B1 | 7/2007 | Cecil et al. | |
| 2001/0003687 | A1 | 6/2001 | Kondo | |
| 2002/0027013 | A1 | 3/2002 | Kondo | |
| 2002/0053458 | A1 | 5/2002 | Kondo | |
| 2008/0185169 | A1 | 8/2008 | Daito | |
| 2010/0035482 | A1 * | 2/2010 | Nakamura | H01R 4/185 439/775 |
| 2010/0130072 | A1 | 5/2010 | Cecil et al. | |
| 2011/0186352 | A1 | 8/2011 | Cecil et al. | |
| 2013/0252481 | A1 | 9/2013 | Sato et al. | |
| 2014/0206245 | A1 * | 7/2014 | Sato | H01R 43/005 439/878 |
| 2015/0091206 | A1 * | 4/2015 | Sato | B29C 45/14065 264/229 |

FOREIGN PATENT DOCUMENTS

| | | | |
|---|---|---|---|
| JP | 2001-162647 | A | 6/2001 |
| JP | 2002127188 | A | 5/2002 |
| JP | 2002216926 | A | 8/2002 |
| WO | 2007/075934 | A1 | 7/2007 |
| WO | 2012/081552 | A1 | 6/2012 |

OTHER PUBLICATIONS

Communication issued on Jun. 17, 2015 by the State Intellectual Property Office of the PR of China in related Application No. 201280041219.5.

International Search Report for PCT/JP2012/071372 dated Nov. 7, 2012 [PCT/ISA/210].

Written Opinion for PCT/JP2012/071372 dated Nov. 7, 2012 [PCT/ISA/237].

Communication issued on Dec. 29, 2015 by the State Intellectual Property Office of the PR of China in Chinese Application No. 201280041219.5.

Office Action dated Jun. 2, 2016, issued by the State Intellectual Property Office of P.R. China in counterpart Chinese Application No. 201280041219.5.

Office Action dated Nov. 1, 2016 issued by the State Intellectual Property Office of the P.R. of China in counterpart Chinese Patent Application No. 201280041219.5.

* cited by examiner

METHOD OF CONNECTING ELECTRIC CABLE TO CONNECTOR TERMINAL AND COMPRESSION-MOLDING DIE

CROSS REFERENCE TO RELATED APPLICATIONS

This application is a continuation of PCT application No. PCT/JP2012/071372, which was filed on Aug. 17, 2012 based on Japanese Patent Application (No. 2011-182992) filed on Aug. 24, 2011, the contents of which are incorporated herein by reference.

BACKGROUND OF THE INVENTION

1. Field of the Invention

The present invention relates to a method of connecting an electric cable to a connector terminal and a compression-molding die.

2. Description of the Related Art

In the related art, a technique is known in which, in order to maintain a waterproof property in a connector terminal to be connected to an end portion of a cable, a mold portion of a molding cavity is provided inside a molding metallic die configured of upper and lower dies, which accommodates and sets the terminal connection portion that compresses a terminal fitting to a conductor of a front end portion of a coated electric cable, and a mold resin in a molten state is injected into the mold portion and thereby the terminal connection portion is coated and molded (for example, see JP-A-2001-162647).

SUMMARY OF THE INVENTION

As described above, in the connector terminal in which the compressing-connection portion is molded, after a compression process in which an electric cable is compressed by crimping is performed, the electric cable is taken out from a crimping machine and arranged in a molding machine. In addition, in the molding machine, a molding process is performed in which a mold resin is injected and the resin mold is molded. Thus, it is necessary to provide separate pieces of equipment which perform a compression process and a molding process, respectively, and equipment costs increase. In addition, as described above, in a case where the compression process and the molding process are performed by separate facilities, improvement of productivity through automation is difficult.

The present invention is made in view of the situation described above. An object of the present invention is to provide a method of connecting an electric cable to a connector terminal and a compression-molding die by which equipment costs are suppressed and automation is easily performed and thereby productivity can be improved.

In order to achieve the object described above, a connection method of an electric cable to a connector terminal according to aspects of the present invention may be configured by any of following configurations (1) to (3).

(1) A method of connecting an electric cable to a connector terminal including a barrel portion and a tab terminal portion to be electrically connected to a mating terminal, the method including:

arranging the connector terminal in a lower die so that an end portion of the electric cable in which a conductor is exposed from an outer cover is arranged in the barrel portion of the connector terminal, pressing a crimper with respect to the barrel portion to crimp the barrel portion, overlapping the lower die with an upper die to form an injection space around the crimped barrel portion and the end portion of the electric cable; and injecting a resin in the injection space, thereby to form a resin mold that covers and waterproofs a connecting location between the barrel portion and the end portion of the electric cable.

(2) The method according to the configuration (1), wherein the crimper enters a communication hole which is formed in the upper mold when the upper die overlaps the lower die.

(3) The method according to the configuration (1) or (2), wherein the resin is injected in the injection space from a gate hole formed in the upper die or the lower die.

In the method of connecting the electric cable to the connector terminal of the configurations (1) to (3) described above, compression of the electric cable and molding of the resin mold are performed in the same process so that complicated work of moving the connector terminal where the electric cable is compressed can be omitted and simplification of the work can be achieved. In addition, the equipment costs can be decreased and automation can be easily performed and thereby the improvement of productivity can be achieved compared to the case where compression of the electric cable and molding of the resin mold are performed separately in the compression machine and the molding machine, respectively.

In addition, in order to achieve the object described above, a compression-molding die according to aspects of the present invention may be configured by any of the following configurations (4) to (6).

(4) A compression-molding die, including:

a lower die having a terminal accommodating recess which accommodates a connector terminal that includes a barrel portion for arranging an end portion of the electric cable in which a conductor is exposed from an outer cover, and an upper die that has a crimper which presses and crimps the barrel portion of the connector terminal accommodated in the terminal accommodating recess, wherein the upper die and the lower die form an injection space where a resin can be injected around the barrel portion and the end portion of the electric cable by overlapping the lower die with the upper die.

(5) The compression-molding die according to the configuration (4), wherein the upper mold includes a communication hole which the crimper enters when the upper die overlaps the lower die.

(6) The compression-molding die according to the configuration (4) or (5), wherein a gate hole is formed in the upper die or the lower die so that the resin is injected in the injection space from the gate hole.

In the compression-molding die of the configuration (4) to (6) described above, compression of the electric cable and molding of the resin mold can be performed easily in the same process and the complicated work of moving the connector terminal, where the electric cable is compressed, can be omitted and thereby simplification of the work can be achieved. In addition, the equipment costs can be reduced and automation thereof can be easily performed and thereby an improvement in productivity can be achieved compared to a case where compression of the electric cable and molding of the resin mold are performed separately in a compression machine and a molding machine, respectively.

According to the present invention, there are provided a method of connecting an electric cable to a connector terminal and a compression-molding die by which equipment costs are suppressed and automation is easily performed and thereby productivity can be improved.

Hereinabove, the present invention is described briefly. Details of the present invention will be clarified further by reading through the embodiments of the present invention described below with reference to the attached drawings.

DETAILED DESCRIPTION OF THE EXEMPLARY EMBODIMENTS

Hereinafter, an embodiment of the present invention is described with reference to the drawings.

Figure 1:
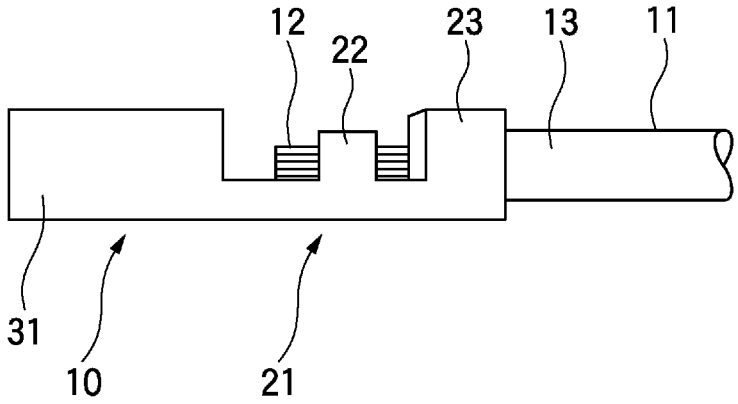
FIG. 1 is a side view of a connector terminal.
Figure 2:
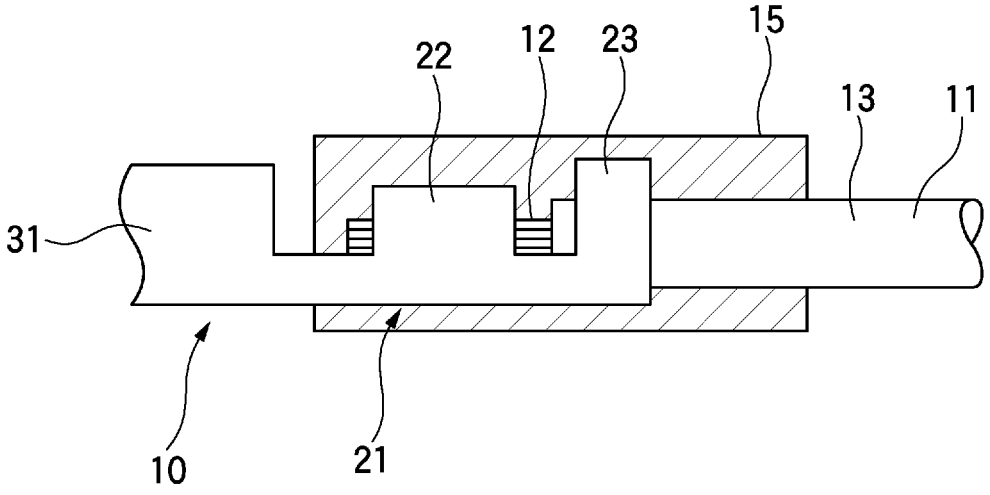
FIG. 2 is a side view of the connector terminal where a resin mold is provided.
Figure 3:
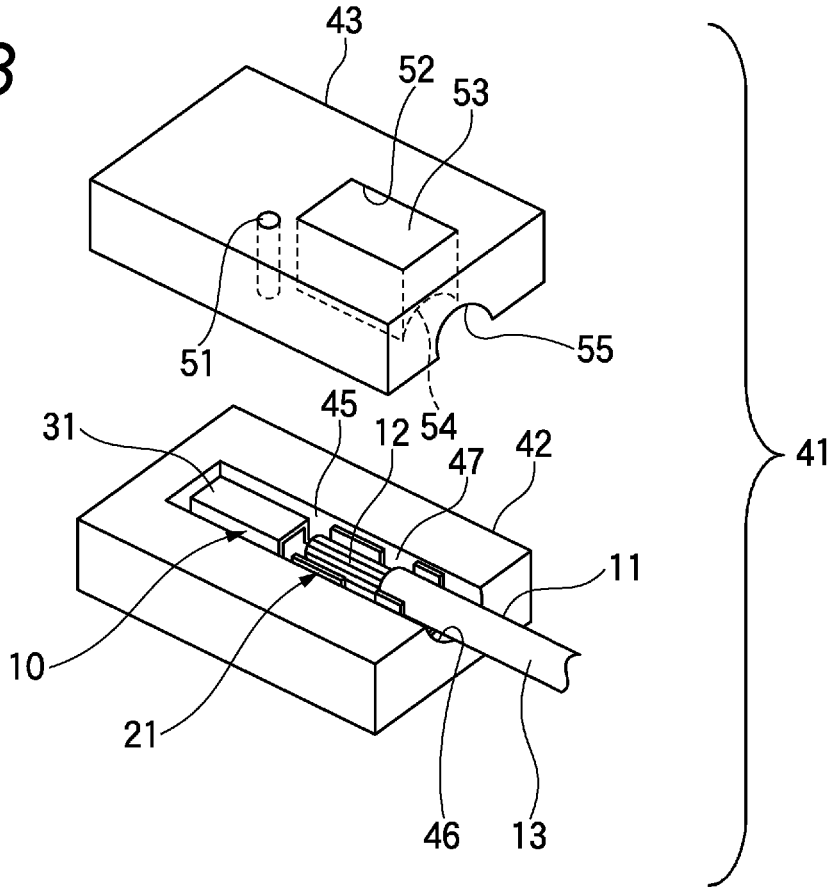
FIG. 3 is a perspective view of a compression-molding die according to an embodiment.

FIG. 1 is a side view of a connector terminal, FIG. 2 is a side view of the connector terminal where a resin mold is provided, FIG. 3 is a perspective view of a compression-molding die according to the embodiment, and FIGS. 4A to 4E are explanatory diagrams for explaining connecting processes of an electric cable to a connector terminal using a compression-molding die.

As shown in FIGS. 1 and 2, a connector terminal 10 in which an electric cable 11 is connected by a connection method according to the embodiment, is formed of a conductive metal material such as copper or copper alloy with, for example, press processing. The connector terminal 10 includes a barrel portion 21 and a tab terminal portion 31.

The electric cable 11, in which the connector terminal 10 is connected, has, for example, a core wire (a conductor) 12 formed of aluminum or aluminum alloy, and an outer cover 13 which is extruded and coated around the core wire 12.

The barrel portion 21 has a core wire crimp part 22 and an outer cover crimp part 23. The core wire crimp part 22 compresses the core wire 12 exposed at an end portion of the electrical cable 11. Accordingly, the core wire 12 of the electric cable 11 and the connector terminal 10 are electrically connected. In addition, the outer cover crimp part 23 compresses the outer cover 13 in the end portion of the electric cable 11. Accordingly, a part of the outer cover 13 of the electric cable 11 is fixed to the connector terminal 10.

In addition, the connector terminal 10 is covered by a resin mold 15 around the periphery of the barrel portion 21 and the end portion of the electric cable 11. As described above, in the connector terminal 10, the connection position between the barrel portion 21 and the electric cable 11 is covered by the resin mold 15 and thereby the connection position of the electric cable 11 can be reliably waterproofed. As in this example, when the electric cable 11, which has the core wire 12 formed of aluminum or aluminum alloy, is connected to the connector terminal 10 formed of copper or copper alloy, there is a tendency for electrolytic corrosion such as bimetallic contact corrosion to arise in the connection position due to the connection position being permeated by water. However, the connection position is covered by the resin mold 15 so that high corrosion resistance can be obtained in the connection position.

Next, the compression-molding die which connects the electric cable 11 to the connector terminal 10 is described.

In the embodiment, as shown in FIG. 3, the electric cable 11 is connected to the connector terminal 10 using the compression-molding die 41. The compression-molding die 41 has a lower die 42 and an upper die 43 which overlaps the lower die 42.

In the lower die 42, a terminal accommodating recess 45 is formed. In addition, in one end side of the lower die 42, an electric cable accommodating groove 46, which communicates with the terminal accommodating recess 45, is formed. The terminal accommodating recess 45 of the lower die 42 can accommodate the connector terminal 10 in a state where the electric cable accommodating groove 46 side is considered to be a mold forming chamber 47 and the barrel portion 21 is arranged in the mold forming chamber 47.

The upper die 43 can move up and down with respect to the lower die 42. The upper die 43 has a gate hole 51 which communicates with the mold forming chamber 47 of the terminal accommodating recess 45 formed in the lower die 42.

In addition, in the upper die 43, a communication hole 52 having a rectangular shape seen in a plan view, which penetrates the front and back surfaces, is formed and a crimper 53 can be inserted into the communication hole 52. In other words, the upper die 43 includes the crimper 53. The crimper 53 has a crimper part 54 at a surface of the lower die 42 side. In addition, the upper die 43 has an electric cable holding groove 55 at a position opposite to the electric cable accommodating groove 46.

Thus, when the upper die 43 overlaps the lower die 42 in a state where the crimper 53 is inserted and accommodated in the communication hole 52, the upper side of the mold forming chamber 47 is covered and thereby an injection space is formed in the compression-molding die 41.

Next, an example is described, where the electric cable 11 is connected to the connector terminal 10 using the compression-molding die 41.

(Arrangement Process)

Figure 4A:
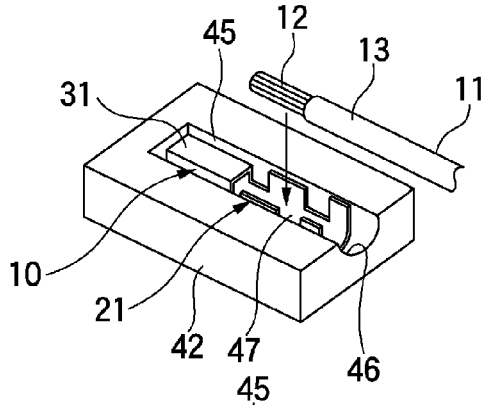
FIGS. 4A to 4E are explanatory diagrams for explaining connecting processes of the electric cable to the connector terminal using the compression-molding die.

First, as shown in FIG. 4A, the connector terminal 10 is accommodated in the terminal accommodating recess 45 of the lower die 42 and an end portion of the electric cable 11, the core wire 12 of which is exposed, is arranged in the barrel portion 21 of the connector terminal 10.

(Compression-Molding Process)

Figure 4B:
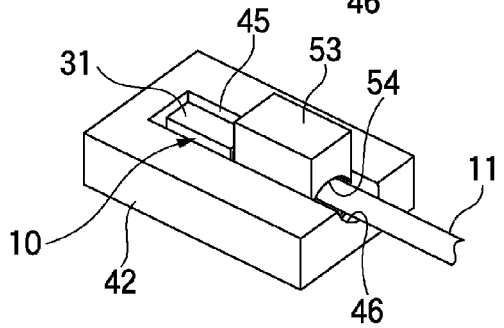
Figure 4C:
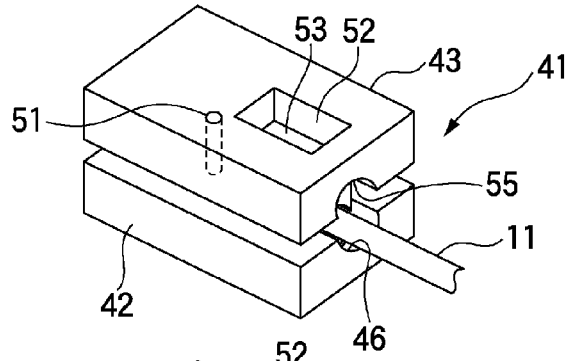
Figure 4D:
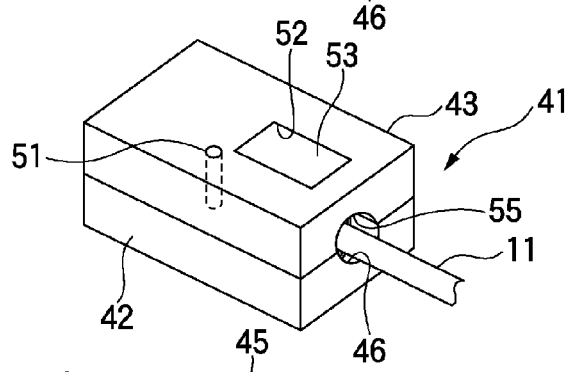

In this state, as shown in FIG. 4B, the crimper 53 moves down and the crimper 53 is pressed to the barrel portion 21 of the connector terminal 10 in the terminal accommodating recess 45. Then, the barrel portion 21 is crimped with respect to the electric cable 11 by the crimper part 54 of the crimper 53 and the electric cable 11 is connected to the barrel portion 21. Furthermore, as shown in FIG. 4C, the upper die 43 moves down. At this time, the crimper 53 enters the communication hole 52 formed in the upper die 43 without interfering with the upper die 43. Thus, as shown in FIG. 4D, the upper die 43 overlaps the lower die 42. Accordingly, the communication hole 52 of the upper die 43 is in a state of being closed by the crimper 53.

Thus, as described above, when the upper die 43 overlaps the lower die 42, the terminal accommodating recess 45 is closed and the injection space is formed by the mold forming chamber 47 and the crimper 53.

In addition, the electric cable 11 is held by the electric cable accommodating groove 46 of the lower die 42 and the electric cable holding groove 55 of the upper die 43 without a gap.

Figure 4E:
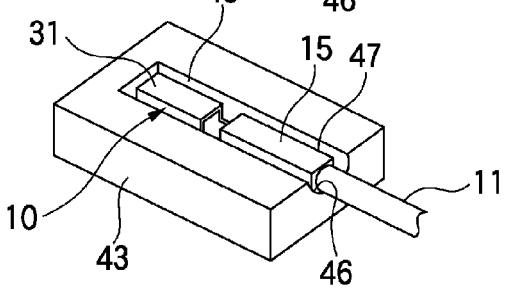

In this state, molten resin is injected from the gate hole 51 into the injection space and after predetermined time elapses, the resin is cured, so that as shown in FIG. 4E, the upper die 43 is moved up with the crimper 53.

(Die Detaching Process)

After that, the electric cable 11 is connected and the connector terminal 10, where the connection position between the barrel portion 21 and the electric cable 11 is covered by the resin mold 15, is detached from the terminal accommodating recess 45 of the lower die 42.

As described above, according to the embodiment, compression of the electric cable 11 and forming of the resin mold 15 can be performed in the same process so that the complicated work of moving the connector terminal 10, where the electric cable 11 is compressed, can be omitted and thereby simplification of the work can be achieved. In addition, the equipment costs can be reduced and automation thereof can be easily performed and thereby an improvement in productivity can be achieved compared to a case where compression of the electric cable 11 and forming of the resin mold 15 are performed separately in a compression machine and a molding machine respectively.

Figure 5:
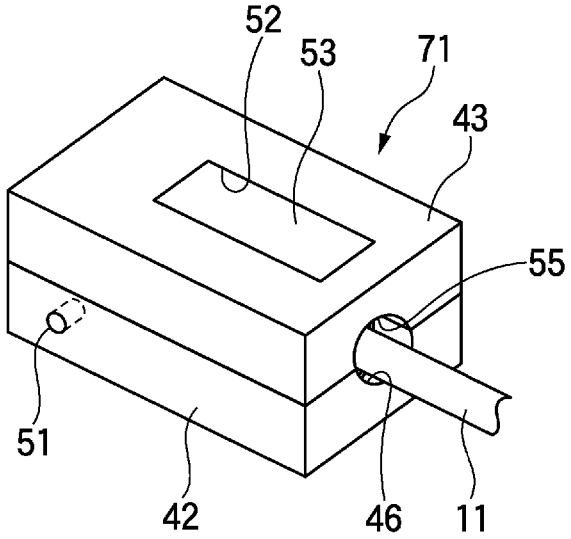
FIG. 5 is a perspective view of a modification example of a compression-molding die.

In the embodiment described above, the gate hole 51 for injection of the resin is formed in the upper die 43 configuring the compression-molding die 41. Alternatively, as shown in FIG. 5, the gate hole 51 may be formed in the lower die 42 (at a side wall).

In addition, the present invention is not limited to the embodiments described above and can be appropriately altered, improved, or the like. In addition, material, shape, dimension, number, arrangement position, or the like of each of the configuration elements in the embodiment described above is arbitrary and is not limited if it can achieve the effects of the present invention.

The present invention is useful since the compression of the electric cable and molding of the resin mold can be performed easily in the same process, whereby equipment costs are suppressed and automation is easily performed and thereby productivity can be improved.

What is claimed is:

1. A method of connecting an electric cable to a connector terminal, the method comprising:

providing the connector terminal including a barrel portion and a tab terminal portion configured to be electrically connected to a mating terminal, exposing a conductor at an end portion of the electric cable from an outer cover of the electric cable, arranging the connector terminal in a lower die so that the end portion of the electric cable in which the conductor is exposed is arranged in the barrel portion of the connector terminal, pressing a crimper with respect to the barrel portion of the connector terminal arranged in the lower die to crimp the barrel portion, overlapping the lower die with an upper die such that the crimper enters a communication hole which is formed in the upper die and closes the communication hole to form an injection space around the crimped barrel portion and the end portion of the electric cable, the injection space being defined by the lower die, the upper die and the crimper closing the communication hole; and injecting a resin in the injection space, thereby to form a resin mold that covers and waterproofs a connecting location between the barrel portion and the end portion of the electric cable, wherein the lower die and the crimper are used during the crimping of the barrel portion and the injecting of the resin.

2. The method according to claim 1, wherein the resin is injected in the injection space from a gate hole formed in the upper die or the lower die.

3. The method according to claim 1, wherein the crimper is included in the upper die.

4. The method according to claim 1, wherein when the crimper enters the communication hole the crimper fluidly closes the communication hole.

5. The method according to claim 1, wherein the lower die is overlapped with the upper die after the crimper is pressed with respect to the barrel portion.

* * * * *